US006112546A

United States Patent [19]

Kim

[11] Patent Number: 6,112,546

[45] Date of Patent: Sep. 5, 2000

[54] AIR CURTAIN GENERATOR FOR REFRIGERATOR

[75] Inventor: Jee-Yong Kim, Incheon, Rep. of Korea

[73] Assignee: Daewoo Electronics Co., Ltd., Seoul, Rep. of Korea

[21] Appl. No.: 09/213,866

[22] Filed: Dec. 17, 1998

[30] Foreign Application Priority Data

Oct. 30, 1998 [KR] Rep. of Korea ..... 98-46142
Oct. 30, 1998 [KR] Rep. of Korea ..... 98-46143

[51] Int. Cl.[7] ..... F25D 11/00

[52] U.S. Cl. ..... 62/440; 62/407; 62/186; 62/256

[58] Field of Search ..... 62/407, 186, 256, 62/440

[56] References Cited

U.S. PATENT DOCUMENTS

| | | | |
|---|---|---|---|
| 5,009,080 | 4/1991 | Naganuma et al. | 62/256 |
| 5,532,534 | 7/1996 | Baker et al. | 310/89 |
| 5,765,388 | 6/1998 | Jeon | 62/408 |
| 5,791,152 | 8/1998 | Choi | 62/89 |
| 5,809,799 | 9/1998 | Jeon | 62/408 |
| 5,826,441 | 10/1998 | Oh | 62/256 |
| 5,857,349 | 1/1999 | Hamaoka et al. | 62/228.4 |
| 5,870,898 | 2/1999 | Choi | 62/89 |
| 5,875,642 | 3/1999 | Lee et al. | 62/256 |
| 5,896,752 | 4/1999 | Park | 62/186 |
| 5,941,087 | 8/1999 | Lee | 62/256 |

*Primary Examiner*—Henry Bennett
*Assistant Examiner*—Mark Schulman
*Attorney, Agent, or Firm*—Jacobson, Price, Holman & Stern, PLLC

[57] ABSTRACT

An air curtain generator generates an air curtain in a refrigerant compartment of a refrigerator. In the air curtain generator, a sensor senses open and closed states of a refrigerant compartment door. A brushless direct current air curtain fan blows cool air into a refrigerant compartment according to a sensing result of the sensor in order to generate an air curtain in the refrigerant compartment. A direct current power source supplies a direct current driving current to the brushless direct current air curtain fan. A driver drives the brushless direct current air curtain fan. A microcomputer controls an operation of the driver according to the sensing result of the sensor. The air curtain generator maximizes functions of an air curtain generator by applying a brushless direct current air curtain fan having low noise level, low power consumption, and high efficiency thereto. The air curtain generator also controls a rotating speed of a brushless direct current air curtain fan according to a state of the refrigerant compartment to thereby adjust air speed.

5 Claims, 9 Drawing Sheets

FIG. 7

| POLARITY OF ROTOR | HALL SENSOR OUTPUT VOLTATE($V_H$) | FIRST POWER TR | SECOND POWER TR | FIRST COIL | SECOND COIL |
|---|---|---|---|---|---|
| N | $V_{H+}$ (HIGH) | HIGH | LOW | HIGH | LOW |
| S | $V_{H-}$ (LOW) | LOW | HIGH | LOW | HIGH |

AIR CURTAIN GENERATOR FOR REFRIGERATOR

BACKGROUND OF THE INVENTION

1. Field of the Invention

The present invention relates to a refrigerator, and more particularly, to an air curtain generator for generating air curtain in a refrigerant compartment of a refrigerator.

2. Prior Art

An air curtain generator is a device which blows cool air generated by an evaporator of a refrigerator into a refrigerant or freezing compartment to generate an air curtain in the refrigerant or freezing compartment.

U.S. Pat. No. 5,765,388, (issued to Yong-Deok Jeon on Jul. 16, 1998) discloses a refrigerator with air curtain generating device for selectively generating an air curtain in a freezing compartment or a refrigerant compartment when a freezing compartment door or a fresh food compartment door is opened.

FIG. 1 shows a conventional air curtain generator 10 of a refrigerator by using an alternating current(AC) air curtain fan. The air curtain generator 10 of a refrigerator 10 includes a microcomputer 102, a driver 104, a relay 106, an AC power source 108, and an AC air curtain fan 110. The microcomputer 102 senses open and closes states of a refrigerant compartment door and generates a sensing result signal according to the sensing result. The sensing result signal from the microcomputer 102 is applied to the driver 104. The driver 104 outputs a relay on/off signal in response to the sensing result signal from the microcomputer 102. The relay 106 turns on or off in response to the relay on/off signal from the driver 104. The AC power source 110 supplies an AC driving current to the AC air curtain fan 110. When the relay 106 is in a turn-on state, the AC air curtain fan 110 rotates and generates and provides an air curtain into a refrigerant compartment. When a refrigerant compartment door is opened, in order to prevent cool air from flowing an outside or to prevent external air from flowing inside of the refrigerator, the AC air curtain fan 110 disposed at a rear side of the refrigerant compartment operates to generate and provide an air curtain into a refrigerant compartment.

Since a conventional air curtain generator for a refrigerator by using an AC air curtain fan has a high noise level, high power consumption, and low efficiency, performance of air curtain operation declines.

SUMMARY OF THE INVENTION

Therefore, it is a first object of the present invention, for the purpose of solving the above mentioned problems, to provide an air curtain generator for a refrigerator by using a BLDC air curtain fan having a low noise level, low power consumption, and high efficiency.

It is a second object of the present invention to provide an air curtain generator for a refrigerator capable of controlling a rotating speed of a BLDC air curtain fan according to a state of a refrigerant compartment.

In order to attain the first object, according to the present invention, there is provided an air curtain generator for a refrigerator, said generator comprising:

a sensor for sensing open and closed states of a refrigerant compartment door;

a brushless direct current air curtain fan for blowing cool air into a refrigerant compartment according to a sensing result of the sensor in order to generate an air curtain in the refrigerant compartment;

a direct current power source for supplying a direct current driving current to the brushless direct current air curtain fan;

a driver for driving the brushless direct current air curtain fan; and a microcomputer for controlling an operation of the driver according to the sensing result of the sensor.

In order to attain the first object, according to the present invention, there is also provided an air curtain generator for a refrigerator, said generator comprising:

a brushless direct current air curtain fan for blowing cool air into a refrigerant compartment in order to generate an air curtain in the refrigerant compartment;

a driver for driving the brushless direct current air curtain fan;

a microcomputer for controlling an operation of the driver, and for judging a state of the refrigerant compartment and generating a pulse width modulation signal having different pulse widths according to the judgement result; and a variable voltage generator for generating a voltage for controlling a rotating speed of the brushless direct current air curtain fan which is variable according the pulse widths of the pulse width modulation signal from the microcomputer.

The present invention maximizes functions of an air curtain generator by applying a BLDC air curtain fan having low noise level, low power consumption, and high efficiency thereto. The present invention controls a rotating speed of a BLDC air curtain fan according to a state of the refrigerant compartment to thereby adjust air speed.

Other objects and further features of the present invention will become apparent from the detailed description when read in conjunction with the attached drawings.

BRIEF DESCRIPTION OF THE DRAWINGS

Other features and advantages of the present invention will become more apparent from the following description taken in connection with the accompanying drawings, wherein:

FIG. 7 is a truth table which illustrates an operation of the PCB shown in FIG. 6;

DETAILED DESCRIPTION OF THE PREFERRED EMBODIMENT

The preferred embodiment of the present invention will hereinafter be described in detail with reference to the accompanying drawings.

Figure 1:
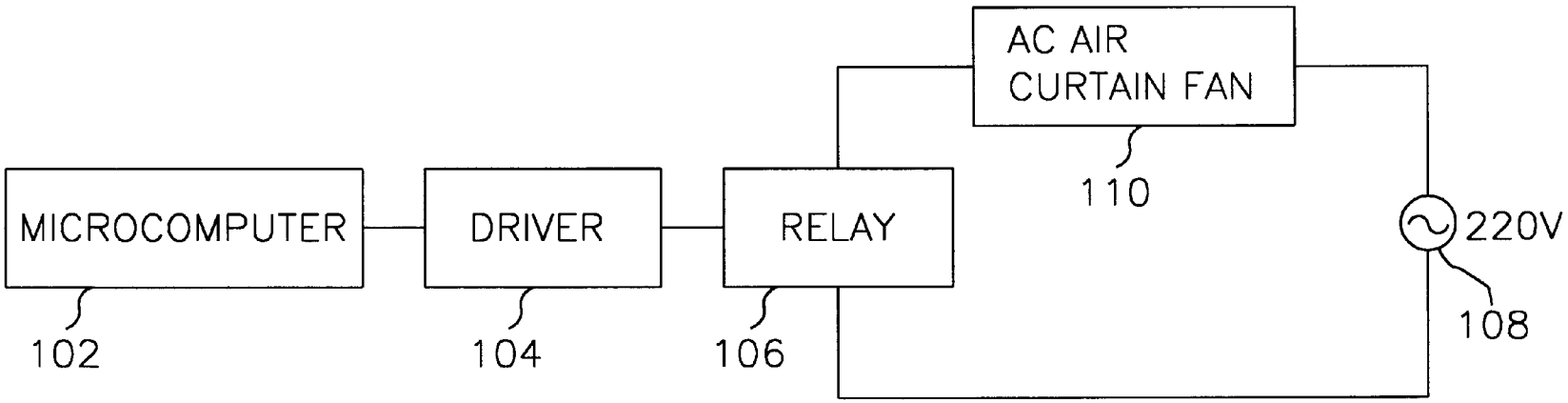
FIG. 1 PRIOR ART
FIG. 1 is a block diagram for showing a conventional air curtain generator of a refrigerator by using an alternating current air curtain fan.
Figure 2:
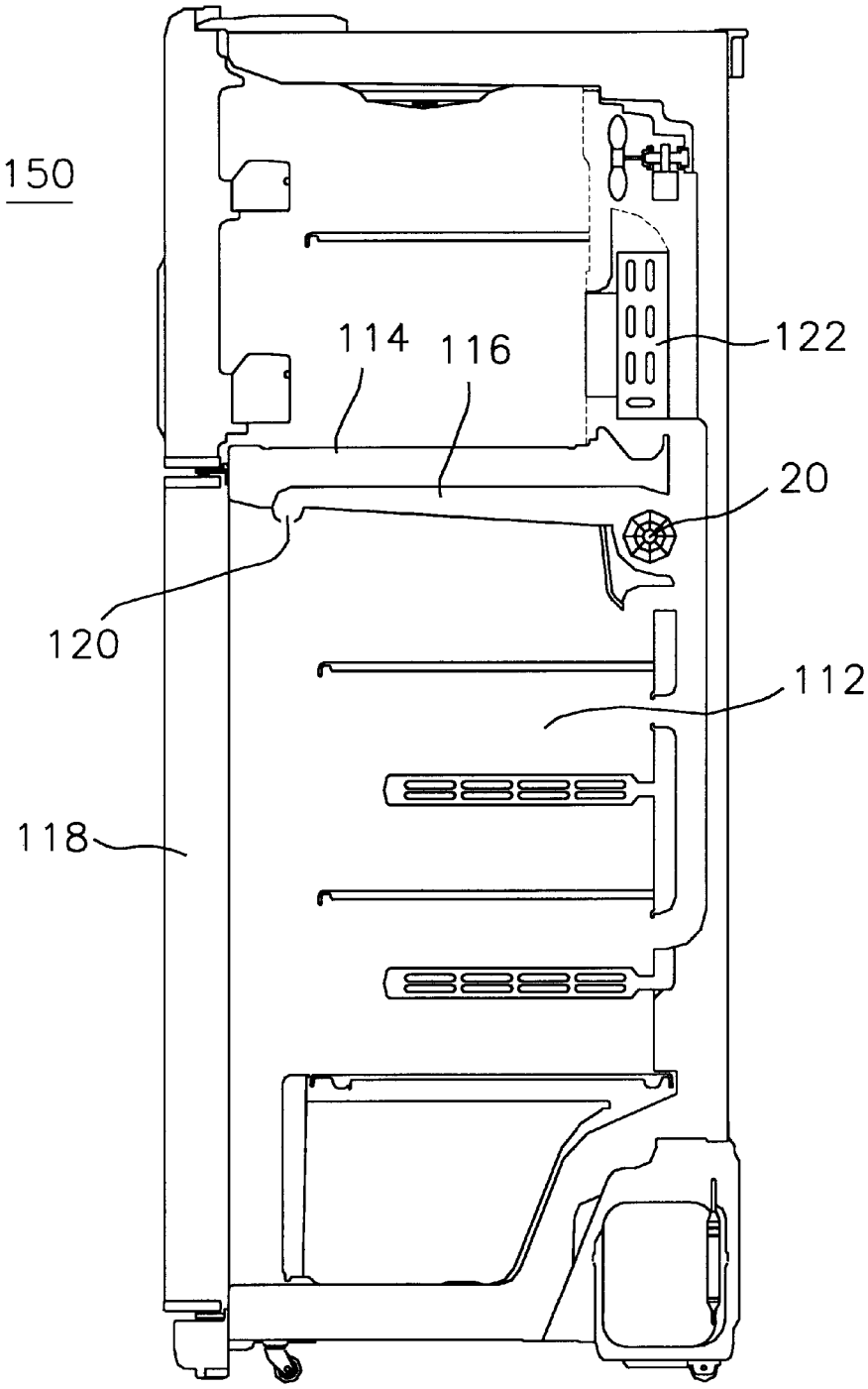
FIG. 2 is a side end view for showing a refrigerator having an air curtain generator according to the present invention.

FIG. 2 shows a refrigerator having an air curtain generator 20 according to the present invention. A circulating duct 116 is defined along a lower surface of a distribution plate 114 at an upper portion of a refrigerant compartment 112. An air curtain generator 20 is mounted at the rear of the circulating duct 116. When a refrigerant compartment door 118 is opened, the air curtain generator 20 operates supplies cool air generated by an evaporator 122 to the refrigerant compartment 112 through a cool air discharge port 120 to thereby produce an air curtain therein.

Embodiment 1

Figure 3:
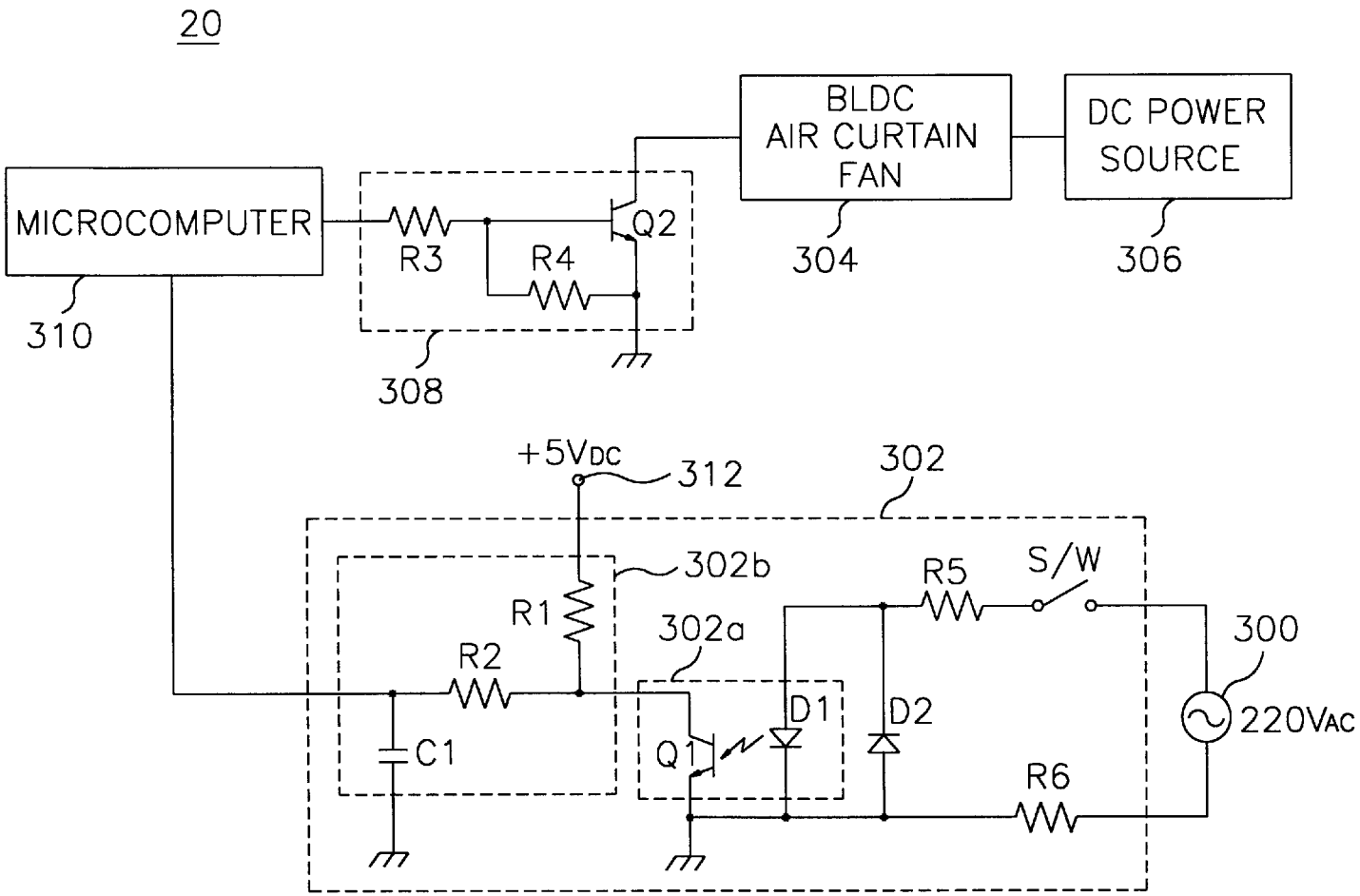
FIG. 3 is a block diagram for showing a configuration of an air curtain generator for a refrigerator according to a first embodiment of the present invention.

FIG. 3 shows a configuration of an air curtain generator for a refrigerator according to a first embodiment of the present invention. The air curtain generator 20 for a refrigerator includes a sensor 302, a brushless direct current (BLDC) air curtain fan 304, a direct current(DC) power source 306, a driver 308, and a microcomputer 310.

The sensor 302 senses open and closed states of a refrigerant compartment door 118. The sensor 302 includes a switch S/W, a photo coupler 302*a,* and an output device 302*b*.

The switch S/W is coupled with an alternating current (AC) power source 300. The switch S/W is open or closed according to the open or closed state of the refrigerant compartment door 118 and switches voltage supply from the AC power source 300. When the refrigerant compartment door 118 is opened, the switch S/W turns on so that voltage from the AC power source 320 is supplied to the photo coupler 302*a*. On the contrary, when the refrigerant compartment door 118 is closed, the switch S/W turns off so that voltage from the AC power source 320 is not supplied to the photo coupler 302*a*.

The photo coupler 302*a* emits light responsive to voltage applied thereto from the AC power source 300 through the switch S/W. The photo coupler 302*a* includes a light emitting diode D1 and a phototransistor Q1. When the switch S/W turns off, the light emitting diode D1 becomes conductive and emits light. The phototransistor Q1 receives the light emitted by the light emitting diode D1.

The output device 302*b* senses the open or closed state of the refrigerant compartment door 118 based on the light emitted by the photo coupler 302*a* and a direct current(DC) voltage +5V from a direct current(DC) power source 312 and outputs a sensing result signal. The output device 302*b* includes a resistor R1 having one terminal connected to the DC power source 312 and the other terminal connected to the collector of the phototransistor Q1. The output device 302*b* includes a resistor R2 having one terminal connected to a junction of the resistor R1 and the collector of the phototransistor Q1 and the other terminal connected to the microcomputer 310. The output device 302*b* includes a capacitor C1 having one terminal connected to a junction of the resistor R2 and microcomputer 310 and the other terminal connected to a ground.

When the switch S/W is in a turn-off state for a predetermined time, that is, when the refrigerant compartment door 118 is open for a predetermined time, both the light emitting diode D1 and phototransistor Q1 are turned off, and the DC current voltage +5V from the DC power source 312 is applied to the output device 302*b* so that the sensing result signal of the output device 302*b* becomes a high level. On the contrary, when the switch S/W is in a turn-on state, that is, when the refrigerant compartment door 118 is closed, the photo coupler 302*a* outputs a high/low signal between 60 to 120 times for 10 seconds to the output device 302*b* so that the sensing result signal of the output device 302*b* is in a high state for 10 seconds and is in a low state thereafter.

Figure 4:
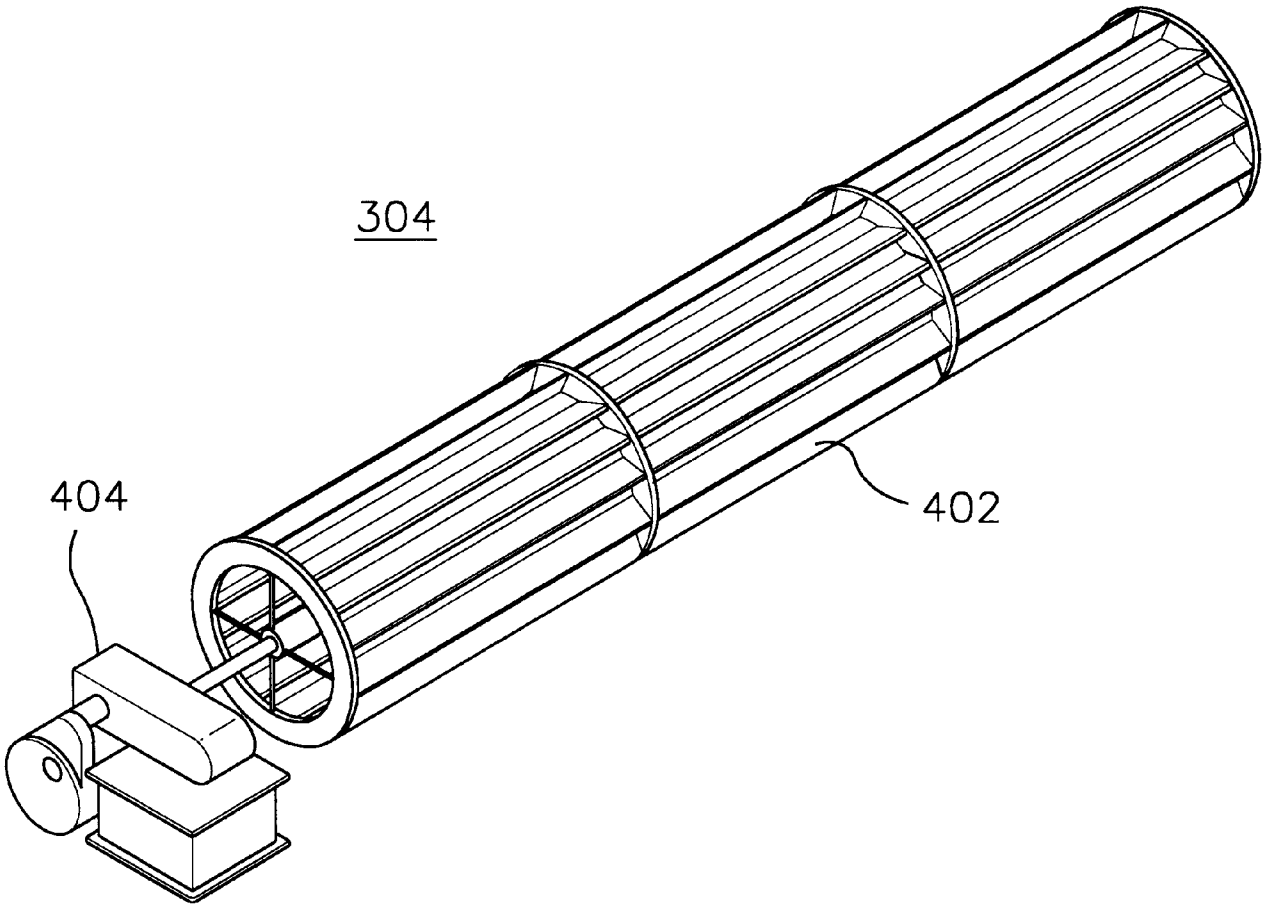
FIG. 4 is an enlarged perspective view of the brushless direct current air curtain fan.

The brushless direct current air curtain fan 304 blows cool air into a refrigerant compartment 112 according to a sensing result of the sensor in order to generate an air curtain in the refrigerant compartment 112. FIG. 4 is an enlarged perspective view of the BLDC air curtain fan 304. The BLDC air curtain fan 304 includes a cross flow fan blades 402 and a BLDC motor 404. The cross flow fan blades 402 blows cool air generated by an evaporator into the refrigerant compartment 112. The BLDC motor 404 is connected to the cross flow fan blades 402 and rotates the cross flow fan blades 402.

Figure 5A:
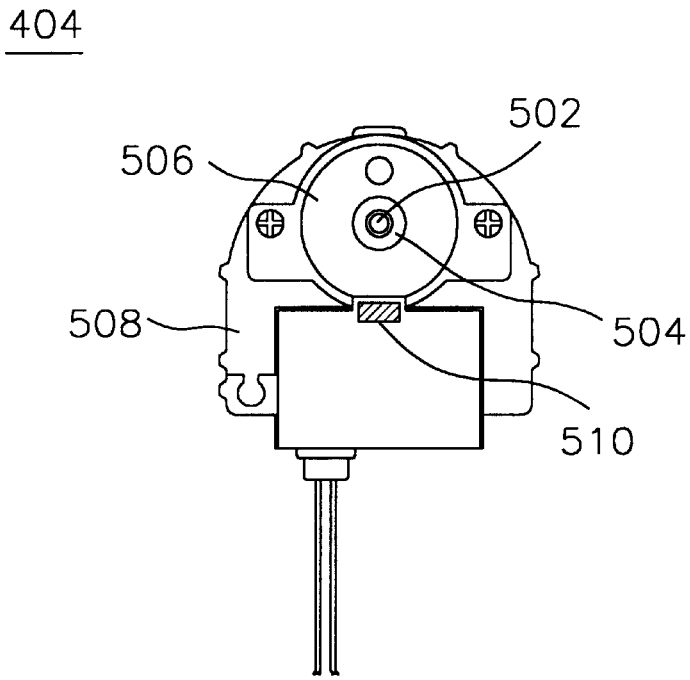
FIG. 5A is a front view of the brushless direct current (BLDC) motor shown in FIG. 4.
Figure 5B:
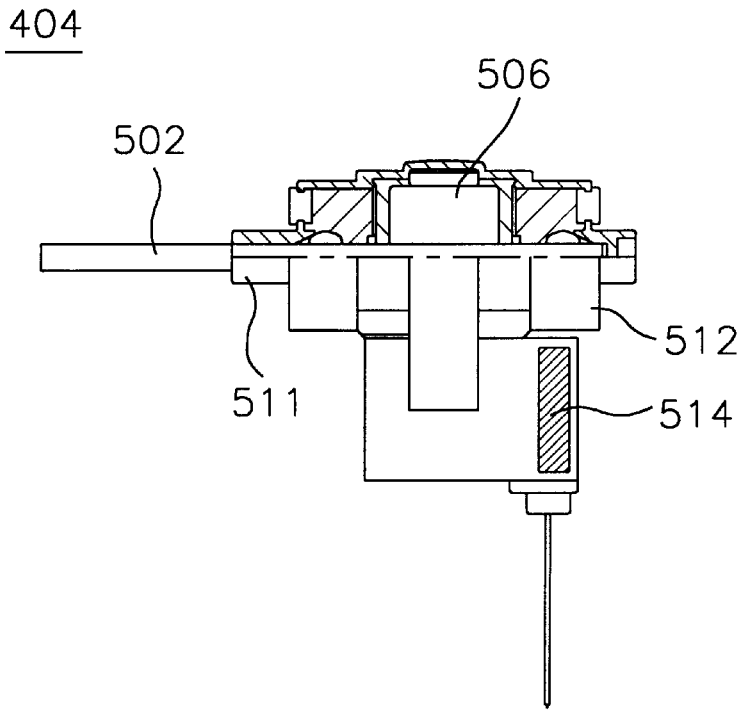
FIG. 5B is a side view of the BLDC motor shown in FIG. 5A.

FIG. 5A is a front view of the brushless direct current (BLDC) motor shown in FIG. 4 and FIG. 5B is a side view of the BLDC motor shown in FIG. 5A.

The BLDC motor 404 includes a shaft 502. A ball bearing 504 surrounds and supports the shaft 502. First and second brackets 511 and 512 adjust the location of the ball bearing 504. A magnet rotor 506 is rotably mounted to an outer side of the ball bearing 504 and has a magnetic north pole N and a magnetic south pole S.

Figure 6:
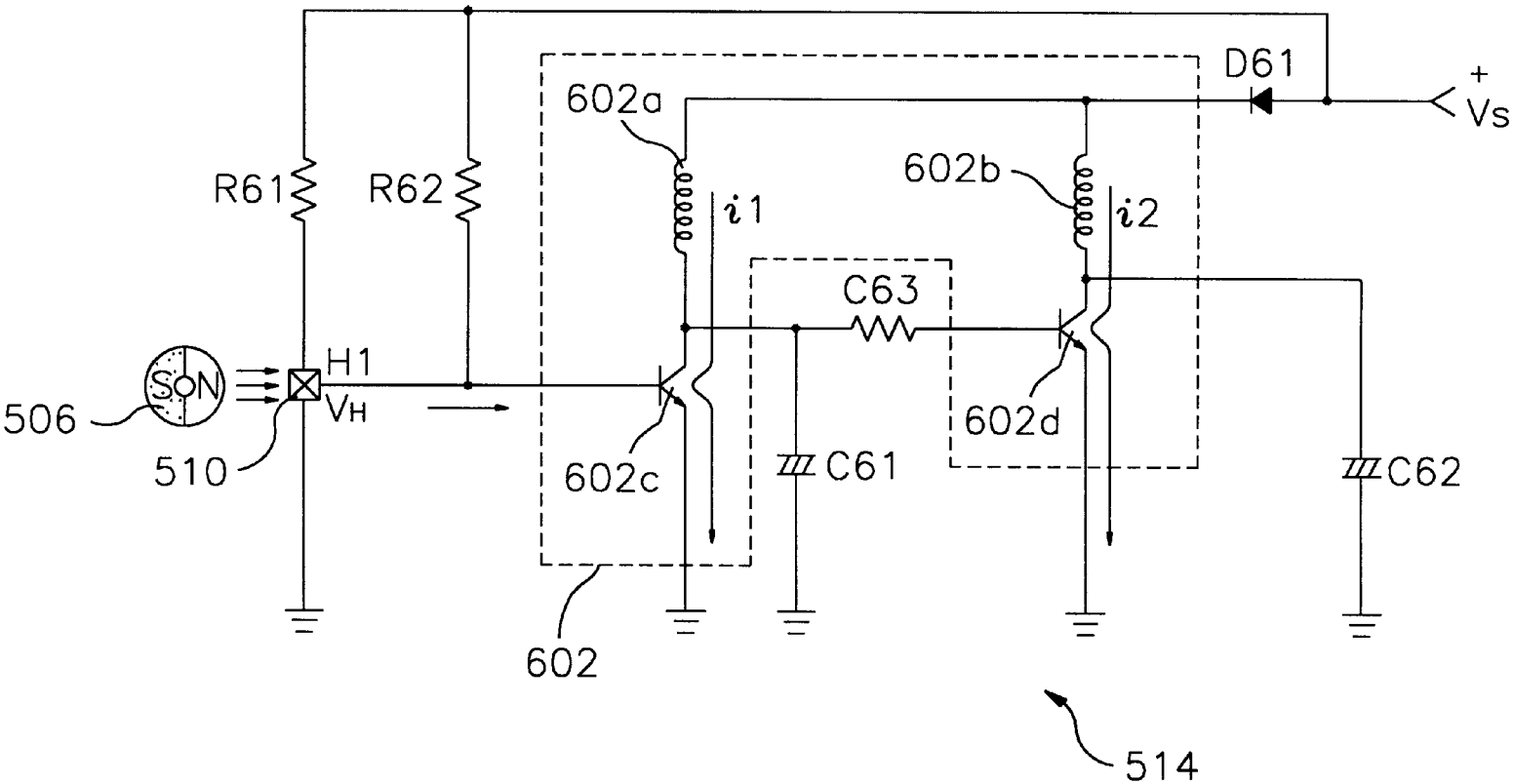
FIG. 6 is a circuitry diagram for showing a configuration of the printed circuit board(PCB) shown in FIG. 5B.

FIG. 6 is a circuitry diagram for showing a configuration of the printed circuit board(PCB) 514 shown in FIG. 5B The PCB 514 includes a Hall sensor 410 and a current generator 602. The Hall sensor 410 senses a location of the magnetic rotor 506 and outputs a location sensing signal. The current generator 602 generates a driving current for controlling a rotation of the magnetic rotor 506 in response to the location sensing signal from the Hall sensor 510. The current generator 602 includes first driving coils 602*a* and 602*b* and first and second power transistors 602*c* and 602*d*. The first driving coils 602*a* and 602*b* are each connected to a power supply Vs. The first driving coils 602*a* and 602*b* are connected to each other in parallel and control the rotation of the magnetic rotor 506.

The first power transistor 602*c* provides a first coil current $i_1$ to the first coil 602*a* in response to the location sensing signal from the Hall sensor 510. The first power transistor 602*c* includes an emitter connected to a ground, a base for receiving the location sensing signal from the Hall sensor 510, and a collector connected to the first driving coil 602*a*. The second power transistor 602d provides a second coil current $i_2$ to the second coil 602*b* in response to the first coil current $i_1$ from the first power transistor 602*c*. The second power transistor 602*d* includes an emitter connected to a ground, a base connected to a junction of a first driving coil 602*a* and the collector of the first power transistor 602*c* for receiving the first coil current $i_1$, and a collector connected to the second driving coil 602*b*. In FIG. 6, R61 and R62 are resistors for removing noise. C61 and C62 are capacitors for removing noise. D61 is a diode.

The DC power source 306 supplies a direct current driving current to the BLDC current air curtain fan 304. The driver 308 drives the BLDC current air curtain fan 304. The driver 308 includes an npn transistor Q2 having an emitter connected to a ground, a base for receiving a control signal from a microcomputer which will be described later, and a collector connected to the BLDC current air curtain fan 304. The npn transistor Q2 includes a base resistor R3 and a resistor R4 which is connected between the base and collector thereof.

The microcomputer 310 controls an operation of the driver 208 according to the sensing result of the sensor 302. In FIG. 3, R5 and R6 are resistors which adjust a current from the AC power source 314 to a rated current flowing through the photo coupler 202*a*. D2 is a diode to prevent the light emitting diode D1 from biasing in reverse.

Hereinafter, an operation of the air curtain generator 30 according to a first embodiment of the present invention will be explained.

When a refrigerant compartment door 118 is opened, the switch S/W is turned off so that the voltage from the AC power source 300 is not supplied to the photo coupler 302*a*. Accordingly, the light emitting diode D1 and phototransistor Q1 are turned off and the DC voltage +5V from the DC power source 312 is applied to the output device 302*b* so that the sensing result signal of the output device 302*b* is a high level. The sensing result signal of the output device 302*b* of a high level is provided to the microcomputer 310.

The microcomputer 310 outputs a driving control signal of a high level in response to the sensing result signal of a high level from the output device 302*b* to the base of the npn transistor Q2 of the driver 208 through the base resistor R3.

The npn transistor Q2 turns on and drives the BLDC air curtain fan 304. At this time, the DC power source 306 supplies a DC driving current to the BLDC air curtain fan 304. Accordingly, the cross flow fan blades 402 of the BLDC air curtain fan 304 operate and blow cool air generated by the evaporator 122 into the refrigerant compartment 112 to produce air curtain therein. The air curtain excludes external air and prevent cool air in the refrigerator from discharging outside. The BLDC motor 404 rotates the cross flow fan blades 402.

An operation of the BLDC air curtain fan 404 will now be described referring to FIG. 5A to FIG. 6.

When the magnetic rotor 506 is in the position shown in FIG. 6, the Hall sensor 510 is extremely adjacent to a magnetic pole of the magnetic rotor 506 and gets the greatest flux.

The Hall sensor 510 senses a magnetic north N pole, sends a driving signal to the first power transistor 602*a* to thereby output a big Hall output voltage $V_{H+}$, and causes the first power transistor 602*a* to become conductive to thereby flow a first coil current $i_1$ so that the first driving coil 602*c* becomes an excited state.

When the first coil current $i_1$ flows, the magnetic north pole is generated on the first driving coil 604 according to Fleming's left-hand rule and the Hall sensor 510 pulls the south pole of the magnetic rotor 506. When the magnetic north pole of the magnetic rotor 506 is far from the Hall sensor 410 by a rotation thereof, the flux which passes through the Hall sensor 510 get lost and a Hall output voltage($V_{H+}$, $V_{H-}$) is not generated in either case. Accordingly, first and second power transistors 602*a* and 602*b* turns off at the same time.

Although the first driving coil 604 transforms to a non-excited state, the magnetic rotor 510 continuously rotates due to the inertia thereof and moves from the magnetic south pole to the magnetic north pole by 180° . At this time, the Hall sensor 510 receives a flux of the magnetic south pole and the second power transistor 602*b*. Accordingly, the second coil current $i_2$ flows so that the second driving coil 602*d* becomes an excited state to thereby generate a magnetic south pole. The generated magnetic south pole pulls a magnetic north pole of the magnetic rotor 406 to generate a rotating force. The operation as mentioned above repeats and a continuous rotation operation continues. FIG. 7 is a truth table which illustrates an operation of the PCB 514.

When the refrigerant compartment door 118 is closed, the switch S/W is turned on so that the voltage from the AC power source 300 is supplied to the photo coupler 202*a*. Accordingly, the light emitting diode D1 becomes conductive to emit light. The phototransistor Q1 receives the light emitted by the light emitting diode D1. That is, the photo coupler 302*a* outputs a high/low signal between 60 to 120 times for 10 seconds to the output device 302*b*. Accordingly, the output device 302*b* outputs the sensing result signal of a high state for 10 seconds to the microcomputer 310 in response to the output signal of the photo coupler 302*a*.

The microcomputer 310 outputs a driving control signal of a high level in response to the sensing result signal of a high level from the output device 302*b* to the base of the npn transistor of the driver 308 through the base resistor R3.

The npn transistor Q2 turns on and drives the BLDC air curtain fan 304 for 10 seconds to thereby refrigerate the refrigerant compartment 112 at a fixed temperature.

Embodiment 2

Figure 8:
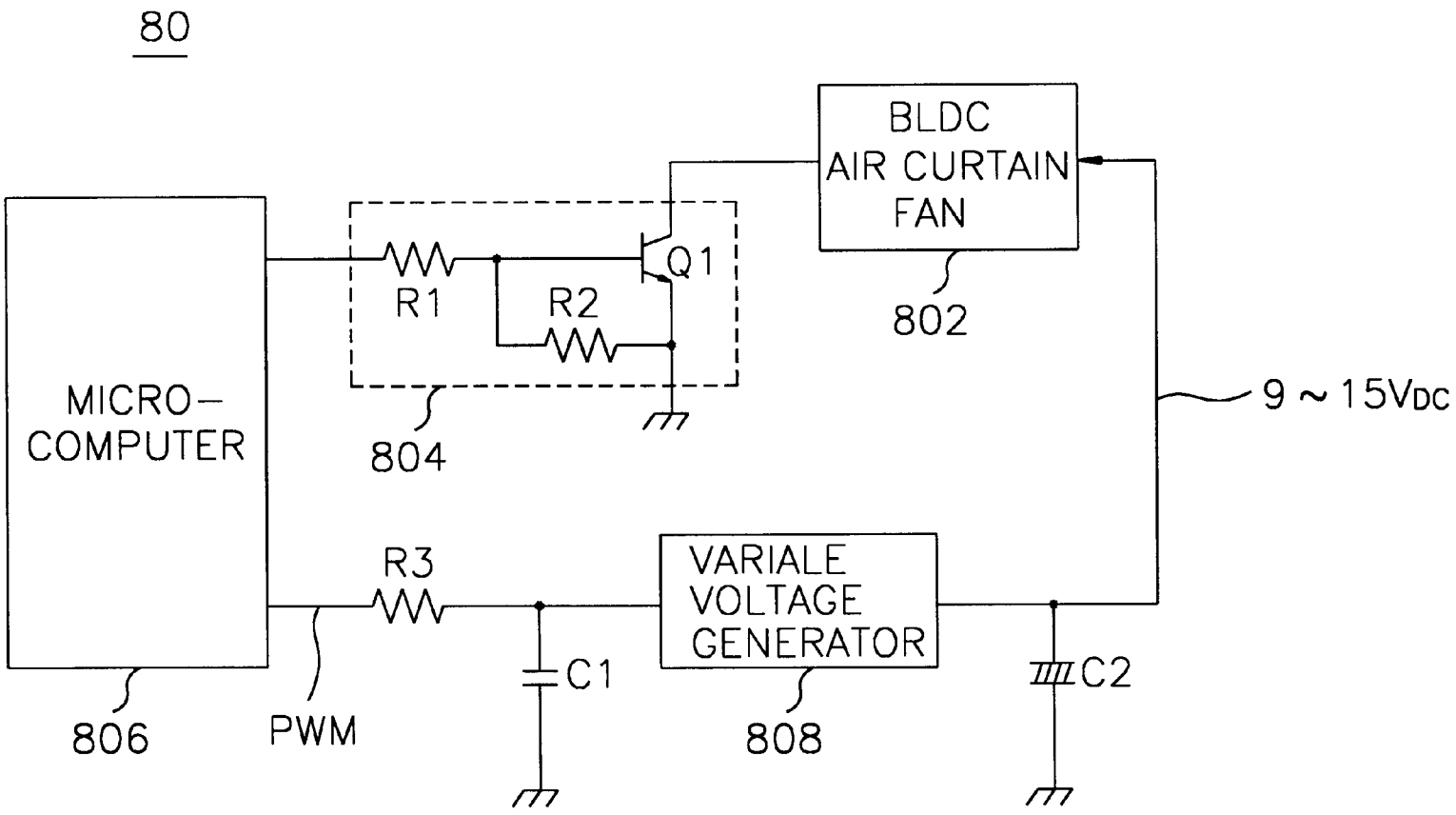
FIG. 8 is a block diagram for showing a configuration of an air curtain generator for a refrigerator according to a second embodiment of the present invention.

FIG. 8 shows a configuration of an air curtain generator for a refrigerator 80 according to a second embodiment of the present invention. The air curtain generator 80 for a refrigerator includes a brushless direct current(BLDC) air curtain fan 802, a driver 804, a microcomputer 806, and a variable voltage generator 808.

The BLDC air curtain fan 802 blows cool air into a refrigerant compartment 112 in order to generate air curtain in the refrigerant compartment 112. The driver 804 drives the BLDC air curtain fan 802. The BLDC air curtain fan 802 has the same configuration and function as those of the BLDC air curtain fan 302 shown in FIG. 3.

Figures 9A, 9B, 9C:
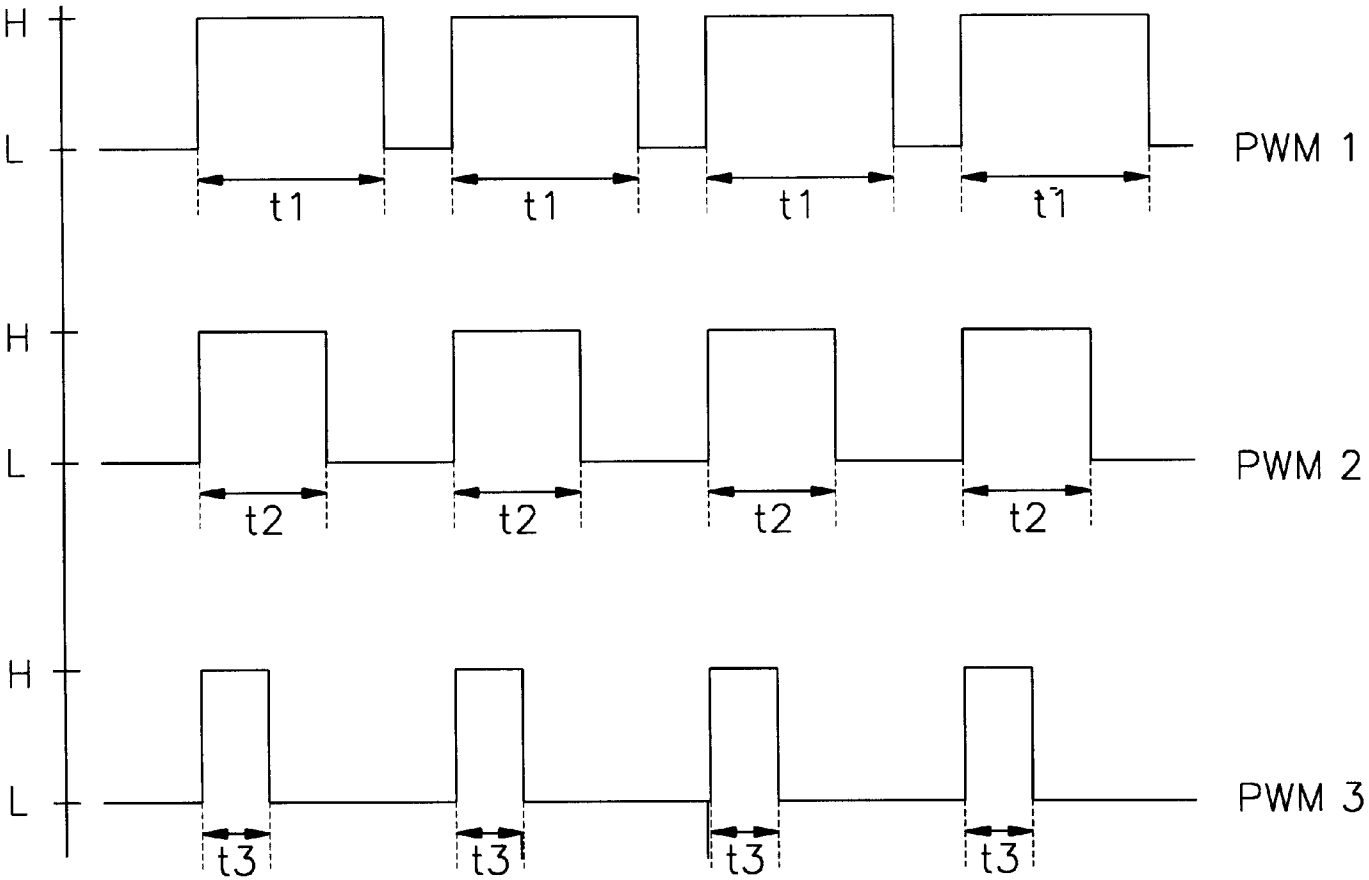
FIGS. 9A to 9C are waveforms for showing pulse width modulation signals generated by a microcomputer shown in FIG. 8.

The microcomputer 806 controls an operation of the driver 704. The microcomputer 806 judges a state of the refrigerant compartment 112 and generates a pulse width modulation signal PWM having different pulse widths according to the judgement result. FIG. 9A shows a first pulse width modulation signal PWM1 having a first pulse width t1 the microcomputer 806 outputs when the refrigerant compartment door 118 is opened or a refrigeration is performed at high speed. FIG. 9B shows a second pulse width modulation signal PWM2 having a second pulse width t2 the microcomputer 806 outputs when an open refrigerant compartment door 118 is closed. FIG. 9C shows a third pulse width modulation signal PWM3 having a third pulse width t3 the microcomputer 806 outputs when an normal operation of a refrigerator is carried out.

The variable voltage generator 808 generates a voltage for controlling a rotating speed of the BLDC air curtain fan 702 which is variable according the pulse widths of the pulse width modulation signal PWM from the microcomputer 806.

Hereinafter, an operation of the air curtain generator 80 according to a second embodiment of the present invention will be described.

The microcomputer 806 judges a state of the refrigerant compartment 112 and generates a pulse width modulation signal PWM having different pulse widths according to the judgement result. That is, when the refrigerant compartment door 118 is opened or refrigeration is performed at high speed, when an open refrigerant compartment door 118 is closed, or when an normal operation of a refrigerator is carried out, the microcomputer 806 outputs a first pulse width modulation signal PWM1 having a first pulse width t1 as shown in FIG. 8A, a second pulse width modulation signal PWM2 having a second pulse width t2 as shown in FIG. 9B, or a third pulse width modulation signal PWM3 having a third pulse width t3 as shown in FIG. 9C, respectively. The first, second, or third pulse width modulation signal is provided to the variable voltage generator 708 through the resistor R3.

The variable voltage generator 808 generates a voltage for controlling a rotating speed of the BLDC air curtain fan 802 which is variable according to the pulse widths of the pulse width modulation signal PWM from the microcomputer 806.

TABLE 1

| | APPLIED VOLTAGE | ROTATING SPEED OF BLDC FAN |
|---|---|---|
| REFRIGERANT COMPARTMENT DOOR OPENED OR REFRIGERATION AT HIGH SPEED | +15 $V_{DC}$ | HIGH SPEED |
| REFRIGERANT COMPARTMENT DOOR IS CLOSED | +12 $V_{DC}$ | MIDDLE SPEED |
| NOMRAL OPERATION | +9 $V_{DC}$ | LOW SPEEED |

Referring to Table 1, when the refrigerant compartment door 118 is opened, the variable voltage generator 808 supplies a DC +15V to the BLDC air curtain fan 802 and turns on the BLDC air curtain fan 802 for 70 seconds. From now on, although the refrigerant compartment door 118 is opened, the BLDC air curtain fan 802 is turned off. When refrigeration is performed at high speed, the variable voltage generator 808 supplies a DC +15V to the BLDC air curtain fan 802 and turns on the BLDC air curtain fan 702 at high speed. At this time, a compressor(not shown) and a cooling fan(not shown) remain on for 40 minutes. Thereafter when a temperature of the refrigerant compartment 112←7° C., the refrigeration at high speed is cancelled to thereby turn off the BLDC air curtain fan 802.

When an open refrigerant compartment door 118 is closed, the variable voltage generator 808 supplies a DC +12V to the BLDC air curtain fan 802 and turns on the BLDC air curtain fan 702 at middle speed for 10 seconds.

When a normal operation of a refrigerator is carried out, the variable voltage generator 808 supplies a DC +9V to the BLDC air curtain fan 802 and turns on the BLDC air curtain fan 702 30 seconds per 1 hour at middle speed for 10 seconds. Thereafter, when a temperature of the refrigerant compartment 112←3° C., the BLDC air curtain fan 802 is turned off.

As mentioned above, the present invention maximizes functions of an air curtain generator by applying a BLDC air curtain fan having low noise level, low power consumption, and high efficiency thereto. The present invention controls a rotating speed of a BLDC air curtain fan according to a state of the refrigerant compartment to thereby adjust air speed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An air curtain generator for a refrigerator, said generator comprising:

a sensor for sensing open and closed states of a refrigerant compartment door;

a brushless direct current air curtain fan for blowing cool air into a refrigerant compartment according to a sensing result of the sensor in order to generate an air curtain in the refrigerant compartment;

a direct current power source for supplying a direct current driving current to the brushless direct current air curtain fan;

a driver for driving the brushless direct current air curtain fan; and a microcomputer for controlling an operation of the driver according to the sensing result of the sensor, wherein the sensor includes a switch coupled with an alternating current power source, the switch being open or closed according to the open or closed state of the refrigerant compartment door for switching voltage supply from the alternating current power source; a photo coupler for emitting light responsive to voltage applied thereto from the alternating current power source through the switch; and an output device for sensing the open or closed state of the refrigerant compartment door based on the light emitted by the photo coupler and a direct current voltage from a direct current power source and outputting a sensing result signal.

2. An air curtain generator for a refrigerator, said generator comprising:

a brushless direct current air curtain fan for blowing cool air into a refrigerant compartment in order to generate an air curtain in the refrigerant compartment;

a driver for driving the brushless direct current air curtain fan;

a microcomputer for controlling an operation of the driver, and for judging a state of the refrigerant compartment and generating a pulse width modulation signal having different pulse widths according to the judgement result; and a variable voltage generator for generating a voltage for controlling a rotating speed of the brushless direct current air curtain fan which is variable according the pulse widths of the pulse width modulation signal from the microcomputer.

3. The air curtain generator as set forth in claim 2, wherein when the refrigerant compartment door is opened or a refrigeration is performed at high speed, when an open refrigerant compartment door is closed, and an normal operation of a refrigerator is carried out, the microcomputer outputs first, second, and third pulse width modulation signals having first, second, and third pulse widths, respectively.

4. The air curtain generator as set forth in claim 2, wherein when the refrigerant compartment door is opened or a refrigeration is performed at high speed, when an open refrigerant compartment door is closed, and a normal operation of a refrigerator is carried out, rotating the brushless direct current air curtain fan at low, middle, and high speeds, respectively.

5. The air curtain generator as set forth in claim 4, wherein when the refrigerant compartment door is opened, when the open refrigerant compartment door is closed, and the normal operation of a refrigerator is carried out, turning on the brushless direct current air curtain fan for seventy seconds, at middle speed for ten seconds, and for thirty seconds per one hour at middle high speed, respectively.

* * * * *